US010494775B2

(12) United States Patent
Hoerster

(10) Patent No.: US 10,494,775 B2
(45) Date of Patent: Dec. 3, 2019

(54) DEVICE FOR COMPACTING A SUBSTRATE

(71) Applicant: AMMANN SCHWEIZ AG, Langenthal (CH)

(72) Inventor: Jochen Hoerster, Bergisch Gladbach (DE)

(73) Assignee: AMMANN SCHWEIZ AG, Langenthal (CH)

( * ) Notice: Subject to any disclaimer, the term of this patent is extended or adjusted under 35 U.S.C. 154(b) by 0 days.

(21) Appl. No.: 16/108,509

(22) Filed: Aug. 22, 2018

(65) Prior Publication Data

US 2019/0078272 A1 Mar. 14, 2019

Related U.S. Application Data

(63) Continuation of application No. PCT/EP2017/052093, filed on Feb. 1, 2017.

(30) Foreign Application Priority Data

Feb. 22, 2016 (DE) ..... 10 2016 103 024

(51) Int. Cl.

| | |
|---|---|
| ***E01C 19/00*** | (2006.01) |
| ***E01C 19/38*** | (2006.01) |
| ***E02D 3/074*** | (2006.01) |
| ***E02D 3/068*** | (2006.01) |
| *E02F 3/96* | (2006.01) |

(52) U.S. Cl.

CPC ..... *E01C 19/38* (2013.01); *E02D 3/068* (2013.01); *E02D 3/074* (2013.01); *E02F 3/967* (2013.01)

(58) Field of Classification Search

CPC ..... E01C 19/38; E02D 3/068; E02D 3/074; E02F 3/967

USPC ..... 404/75, 113, 133.05, 133.1

See application file for complete search history.

(56) References Cited

FOREIGN PATENT DOCUMENTS

| | | |
|---|---|---|
| DE | 20105765 | 8/2001 |
| DE | 102012200908 B1 | 7/2015 |
| EP | 2636798 A1 | 9/2013 |
| EP | 0914523 B1 | 11/2013 |

*Primary Examiner* — Raymond W Addie

(74) *Attorney, Agent, or Firm* — Von Rohrscheidt Patents

(57) ABSTRACT

A device for compacting a substrate, comprising an under carriage with a base arranged on the under carriage; a superstructure which is connected to the under carriage so as to transmit a force; a vibration exciter, by means of which at least the base of the undercarriage can be caused to vibrate and a contact plate, which is arranged on the base, said contact plate being arranged on a base lower face facing away from the superstructure such that the contact plate directly contacts the substrate to be compacted during the operation of the device. The contact plate and the base are connected together in a non-destructively releasable manner so as to transmit a force.

12 Claims, 3 Drawing Sheets

DEVICE FOR COMPACTING A SUBSTRATE

RELATED APPLICATIONS

This application is a continuation of International patent application PCT/EP2017/052093 filed on Feb. 1, 2017, claiming priority from German patent application DE 10 2016 103 024.4 filed on Feb. 22, 2016, both of which are incorporated in their entirety by this reference.

FIELD OF THE INVENTION

The invention relates to a device for compacting a substrate, the device comprising:

an under carriage with a base plate arranged on the under carriage;

a superstructure that is connected with the under carriage so that a force is transferrable from the superstructure to the undercarriage wherein the superstructure includes a vibrator that is capable for force at least the base plate of the under carriage to vibrate; and a contact plate arranged at the base plate on a bottom side of the base plate that is oriented away from the superstructure so that the contact plate comes in direct contact with the substrate to be compacted during operation of the device, wherein the contact plate and the base plate are connected with each other so that a force is transferable between the contact plate and the base plate and the contact plate and the base plate are disengageable from each other without damage to the contact plate or the base plate.

The application also relates to a method for mounting a contact plate at a base plate of a device for compacting a substrate, the method comprising the steps:

a) positioning the base plate and the contact plate relative to one another so that the base plate contacts the contact plate at least with a substantial entirety of its surface area, b) connecting the base plate and the contact plate so that a force is transferrable between the base plate and the contact plate and a movement of the contact plate relative to the base plate is blocked at least in a forward direction of the device.

The device described supra can be for example a so called vibrating plate which is moved over the substrate to be compacted by remote control or manually. If the device is moved by hand it typically includes a tow bar by which a person operating the device can steer the device.

The "base plate" of the device designates the component through which the device typically contacts the ground to be compacted. Therefore, the base plate is the component by which the device transfers the generated forces to the substrate to be compacted. Typically, the base plate is formed by a steel element with several millimeters thickness.

The device according to the invention includes an additional contact plate on a side of the base plate that is oriented towards the substrate wherein the contact plate contacts the ground to be compressed during operations of the device in lieu of the base plate. A contact plate of this type can be formed for example by a plastic material, wherein the contact plate can be used in particular to dampen forces impacting the substrate in order to prevent the substrate from being damaged. It is also conceivable that the contact plate is formed from steel and assumes the function of a wear protection plate which protects the base plate of the device against direct impact of forces.

The term "plate" according to the instant application with respect to the base plate and the contact plate means that the components typically have a thickness which significantly undercuts the other dimensions of the respective components. In particular a thickness of the base plate as well as of the contact plate is typically not more than 30 mm whereas a length and a width of the respective plate is typically several hundred millimeters.

A connection between the contact plate and the base plate that is disengageable without damage is a connection that can be engaged and disengaged again at will without one of the plates getting damaged, In particular it is conceivable that the contact plate is connected by a fastener, e.g., a threaded bolt at the base plate. It is appreciated that this connection can be disengaged again at will so that neither the base plate nor the contact plate is damaged.

The "force transmitting connection" between the base plate and the contact plate does not have to be provided directionally independent. In order to be able to operate the device including the contact plate in a sensible manner it is typically only required that a relative movement between the plates in a forward direction of the device is prevented by the force transmitting connection between the base plate and the contact plate. This means that the contact plate should not disengage from the base plate during a forward movement of the device which represents its primary operating direction so that the device including its base plate moves forward while the contact plate remains stationary.

As a matter of principle, it is conceivable that the force transmitting connection between the base plate and the contact plate acts in other directions relative to the device. A directionally independent coupling of base plate and contact plate, however, is not implied by the currently used term "force transmitting connection".

BACKGROUND OF THE INVENTION

Devices and methods of the type recited supra are known in the art. As described supra the contact plates can be wear protection plates as well as insulation plates.

Embodiments of the generic device are disclosed in the documents EP 0 914 523 B1 and DE 201 05 765. Furthermore, reference is made to the German patent DE 10 2012 200 908 B1 owned by applicant.

The devices disclosed in the documents recited supra have in common that the provided contact plates are arranged at the base plates requiring tools for assembly and disassembly. Thus, as illustrated supra a respective contact plate is attached at the base plate itself and on the other hand side the contact plate is attached by a connection arrangement at the superstructure of the device. In any case it is necessary for mounting or dismounting a prior art contact plate to use tools and fasteners. This is disadvantageous in that proper tools or the required fasteners are typically not on hand at the construction site when the contact plate has to be mounted or dismounted and consequently the work flow initially has to be interrupted in order to get the necessary parts.

BRIEF SUMMARY OF THE INVENTION

The invention relates to a device for compacting a substrate, the device comprising:

an under carriage with a base plate arranged on the under carriage;

a superstructure that is connected with the under carriage so that a force is transferrable from the superstructure to the undercarriage wherein the superstructure includes a vibrator that is capable for force at least the base plate of the under carriage to vibrate; and a contact plate arranged at the base plate on a bottom side of the base plate that is oriented away from the superstructure so that the contact plate comes in direct contact with the substrate to be compacted during operation of the device, wherein the contact plate and the base plate are connected with each other so that a force is transferable between the contact plate and the base plate and the contact plate and the base plate are disengageable from each other without damage to the contact plate or the base plate.

The application also relates to a method for mounting a contact plate at a base plate of a device for compacting a substrate, the method comprising the steps:

a) positioning the base plate and the contact plate relative to one another so that the base plate contacts the contact plate at least with a substantial entirety of its surface area, b) connecting the base plate and the contact plate so that a force is transferrable between the base plate and the contact plate and a movement of the contact plate relative to the base plate is blocked at least in a forward direction of the device.

The device described supra can be for example a so called vibrating plate which is moved over the substrate to be compacted by remote control or manually. If the device is moved by hand it typically includes a tow bar by which a person operating the device can steer the device.

The "base plate" of the device designates the component through which the device typically contacts the ground to be compacted. Therefore, the base plate is the component by which the device transfers the generated forces to the substrate to be compacted. Typically, the base plate is formed by a steel element with several millimeters thickness.

The device according to the invention includes an additional contact plate on a side of the base plate that is oriented towards the substrate wherein the contact plate contacts the ground to be compressed during operations of the device in lieu of the base plate. A contact plate of this type can be formed for example by a plastic material, wherein the contact plate can be used in particular to dampen forces impacting the substrate in order to prevent the substrate from being damaged. It is also conceivable that the contact plate is formed from steel and assumes the function of a wear protection plate which protects the base plate of the device against direct impact of forces.

The term "plate" according to the instant application with respect to the base plate and the contact plate means that the components typically have a thickness which significantly undercuts the other dimensions of the respective components, In particular a thickness of the base plate as well as of the contact plate is typically not more than 30 mm whereas a length and a width of the respective plate is typically several hundred millimeters.

A connection between the contact plate and the base plate that is disengageable without damage is a connection that can be engaged and disengaged again at will without one of the plates getting damaged. In particular it is conceivable that the contact plate is connected by a fastener, e.g., a threaded bolt at the base plate. It is appreciated that this connection can be disengaged again at will so that neither the base plate nor the contact plate is damaged.

The "force transmitting connection" between the base plate and the contact plate does not have to be provided directionally independent. In order to be able to operate the device including the contact plate in a sensible manner it is typically only required that a relative movement between the plates in a forward direction of the device is prevented by the force transmitting connection between the base plate and the contact plate. This means that the contact plate should not disengage from the base plate during a forward movement of the device which represents its primary operating direction so that the device including its base plate moves forward while the contact plate remains stationary.

As a matter of principle, it is conceivable that the force transmitting connection between the base plate and the contact plate acts in other directions relative to the device. A directionally independent coupling of base plate and contact plate, however, is not implied by the currently used term "force transmitting connection".

The invention relates to a device for compacting a substrate, the device comprising:

an under carriage with a base plate arranged on the under carriage;

a superstructure that is connected with the under carriage so that a force is transferrable from the superstructure to the undercarriage wherein the superstructure includes a vibrator that is capable for force at least the base plate of the under carriage to vibrate; and a contact plate arranged at the base plate on a bottom side of the base plate that is oriented away from the superstructure so that the contact plate comes in direct contact with the substrate to be compacted during operation of the device, wherein the contact plate and the base plate are connected with each other so that a force is transferable between the contact plate and the base plate and the contact plate and the base plate are disengageable from each other without damage to the contact plate or the base plate.

The application also relates to a method for mounting a contact plate at a base plate of a device for compacting a substrate, the method comprising the steps:

a) positioning the base plate and the contact plate relative to one another so that the base plate contacts the contact plate at least with a substantial entirety of its surface area, b) connecting the base plate and the contact plate so that a force is transferrable between the base plate and the contact plate and a movement of the contact plate relative to the base plate is blocked at least in a forward direction of the device.

The device described supra can be for example a so called vibrating plate which is moved over the substrate to be compacted by remote control or manually. If the device is moved by hand it typically includes a tow bar by which a person operating the device can steer the device.

The "base plate" of the device designates the component through which the device typically contacts the ground to be compacted. Therefore, the base plate is the component by which the device transfers the generated forces to the substrate to be compacted. Typically, the base plate is formed by a steel element with several millimeters thickness.

The device according to the invention includes an additional contact plate on a side of the base plate that is oriented towards the substrate wherein the contact plate contacts the ground to be compressed during operations of the device in lieu of the base plate. A contact plate of this type can be formed for example by a plastic material, wherein the contact plate can be used in particular to dampen forces impacting the substrate in order to prevent the substrate from being damaged. It is also conceivable that the contact plate is formed from steel and assumes the function of a wear protection plate which protects the base plate of the device against direct impact of forces.

The term "plate" according to the instant application with respect to the base plate and the contact plate means that the components typically have a thickness which significantly undercuts the other dimensions of the respective components. In particular a thickness of the base plate as well as of the contact plate is typically not more than 30 mm whereas a length and a width of the respective plate is typically several hundred millimeters.

A connection between the contact plate and the base plate that is disengageable without damage is a connection that can be engaged and disengaged again at will without one of the plates getting damaged. In particular it is conceivable that the contact plate is connected by a fastener, e.g., a threaded bolt at the base plate. It is appreciated that this connection can be disengaged again at will so that neither the base plate nor the contact plate is damaged.

The "force transmitting connection" between the base plate and the contact plate does not have to be provided directionally independent. In order to be able to operate the device including the contact plate in a sensible manner it is typically only required that a relative movement between the plates in a forward direction of the device is prevented by the force transmitting connection between the base plate and the contact plate. This means that the contact plate should not disengage from the base plate during a forward movement of the device which represents its primary operating direction so that the device including its base plate moves forward while the contact plate remains stationary.

As a matter of principle, it is conceivable that the force transmitting connection between the base plate and the contact plate acts in other directions relative to the device. A directionally independent coupling of base plate and contact plate, however, is not implied by the currently used term "force transmitting connection".

Thus, it is an object of the invention to simplify mounting and dismounting a contact plate at a device for compressing a substrate compared to the prior art.

The object is achieved by the device according to the invention recite supra in that the contact plate includes at least one connection portion that is configured to directly engage the base plate through form locking, wherein the connection portion is formed at the remaining contact plate so that the connection portion extends in an installed condition of the contact plate starting from a bottom side of the contact plate to a top side of the contact plate oriented towards the superstructure and engages the top side at this location. Put differently the connection portion is advantageously configured so that it envelops the base plate in a form locking manner at least in a corresponding portion. This engagement between the contact plate and the base plate is thus provided so that a form locking connection between the contact plate and the base plate is established or establishable solely due to the form locking connection between the contact plate and the base plate.

A "directly form locking connection" according to the instant application is a connection that provides form locking wherein the partners of the form locking connection are the contact plate and the base plate. The specification of this form locking connection as "direct" means that no separate fasteners are used to provide the form locking connection, like e.g. bolt shaped fasteners which penetrate the base plate as well as the contact plate and thus provide a form locking engagement of both components with each other. A form locking connection of the latter type designates only "an indirect" form locking connection according to the instant application. Indirectly form locking connections of this type are well known in the art and are not suitable to implement the advantages of subject matter of the invention which are described infra.

Establishing a force transmitting connection "solely through the effect of the connection portion" means according to the invention that the form locking connection between the contact plate and the base plate is configured to facilitate a force transmission between the recited components. This force transmission is provided so that the device is configured to compress a substrate solely through the effect of the directly from locking connection of contact plate and base plate. Thus, it is not necessary to couple the contact plate and the base plate with each other by separate connection devices or similar in addition to the direct form locking. The instant invention however does not exclude that the contact plate and the base plate are connected with each other by additional fasteners to provide form locking or friction locking however this additional connection is not required to operate the device.

In particular it is conceivable that the contact plate includes plural connection portions which engage the base plate in a form locking manner at several locations, this means in different form locking portions. In particular the contact plate can include a respective connection portion of the type described supra at its two front corners. Through careful placement of several connection portions thus a form locking connection can be provided between the contact plate and the base plate in several directions so that a movement of the contact plate relative to the base plate is blocked independently from a movement direction of the entire device. In particular it is conceivable that at least one connection portion of the contact plate reaches around the base plate in a corner portion so that at least a portion of the connection portion of the contact plate frames the forward oriented outer edge of the base plate and at least one additional portion of the connection portion frames a lateral edge of the base plate. Advantageously the contact plate includes a respective connection portion in both forward corner portions viewed in the forward direction of the device. A corresponding engineering design can be derived from the embodiment described infra.

The force transmission based on the direct form locking is thus configured at least so that the device can perform a forward motion during operations without the contact plate and the base plate disengaging from each other. Put differently the form locking connection between the contact plate and the base plate blocks a relative movement of both components at least parallel to the forward direction of the device. Additionally, it is certainly possible that the direct form locking between the components also facilitates a sideways movement or a backward movement of the device without the contact plate and the base plate performing a movement relative to each other. This will be separately described infra. A form locking thus configured between the components is not mandatory for the primary success of the invention since the device typically moves forward during operations.

The device according to the invention has many advantages. In particular it is possible through the device to couple the contact plate and the base plate with each other without requiring additional connectors. For example, it is not necessary to bolt the contact plate and the base plate together. This has the essential advantage that no additional elements are required at the construction site to mount the contact plate in order to start operating the device with the contact plate. Accordingly, it is not necessary to look for associated tools or to buy fasteners. Furthermore, fasteners cannot be lost, contaminated or damaged or become unusable in other ways so that replacement would be required. This significantly improves work flow at a construction site compared to the prior art. The same applies for the moment in time when the contact plate shall be disengaged from the base plate. Thus, the device according to the invention only requires to disengage the previously established form locking and to remove the contact plate. Labor intensive disengagement of plural bolted connections or similar is therefore not required.

Thus, it is particularly advantageous in this context to run the device which can be advantageously provided as a vibrating plate onto the contact plate in operating condition, in particular from a rear end of the contact plate in a direction towards a front end. In order to connect the contact plate with the base plate of the device it is only required for this procedure to place the contact plate onto the substrate and to run the run the device on the contact plate which can be performed solely by the drive arrangement of the device and optionally supported by muscle force of the operator of the device. When the base plate is run onto the contact plate the base plate and the contact plate eventually engage so that a force is transferable between them. After reaching this condition the device can be used directly together with the contact plate without having to take additional measures.

In this context it can be particularly advantageous when at least one edge side of the contact plate, in particular a rear edge side is configured flat so that the device with the base plate can run onto the contact plate at this edge side, Advantageously a thickness of the contact plate at the edge side should not be more than 7 centimeters advantageously not more than 5 centimeters, further advantageously not more than 4 centimeters.

In a particularly advantageous embodiment of the device according to the invention the connection between the contact plate and the base plate is completely free from any additional fasteners. At least for the performing a forward movement of the device this applies as a matter of principle according to the invention. However, it can also be possible to couple the base plate and the contact plate with each other with additional connectors in addition to the directly form locking connection in order to facilitate e.g. a sideways movement or backward movement of the device. In the illustrated advantageous embodiment of the device an additional fastener is not required either for these types of movements of the device. Put differently the direct form locking between the base plate and the contact plate is advantageously configured so that the device is usable in several movement directions completely independently from additional fasteners.

Furthermore, a device is particularly advantageous where the contact plate and the base plate are connectable with each other without tools and disengageable from each other without tools. With this embodiment it is possible at the construction site anytime to connect the contact plate and the base plate with one another or to disengage them from each other. There is no need to buy any tools. This simplifies operations of the device according to the invention even further.

In a particularly advantageous embodiment of the device according to the invention the contact plate is provided in one piece. This applies in particular for embodiments where the contact plate is formed by a synthetic material. In particular in cases where a contact plate is used for protecting the ground to be compressed against damages and/or for reducing construction noise (insulation plate) contact plates are being used that are comparatively soft so that they have a damping effect. Thus, contact plates are being used in particular which are made from Vulkollan®. This is a polyester urethane rubber material which has a rubbery consistency and a permanent resistance against mechanical loads. Other comparable synthetic materials can certainly also be advantageous. The embodiment of a one-piece contact plate is particularly simple when it is made from a synthetic material since a material of this type can be easily formed into any shape and can thus be adapted for example to various base plate geometries.

The device according to the invention is furthermore advantageous when the contact plate has at least one outer collar that extends perpendicular to its base surface and which forms a lateral contact surface for a corresponding outer edge of the base plate in an installed condition of the contact plate. This collar of the contact plate is advantageously provided at least at longitudinal sides of the contact plate, further advantageously circumferentially so that so to speak the complete circumferential outer edge of the base plate is framed by the outer collar of the contact plate. Thus, the collar of the contact plate is configured so that it blocks a movement of the base plate relative to the contact plate in a direction of the collar of the contact plate.

In another advantageous embodiments of the device according to the invention the contact plate is made from a material with a stiffness that is far below a stiffness of the base plate. Far below according to the instant application means that the stiffness of the contact plate has at the most 25% of the stiffness of the base plate, advantageously at the most 5% of the stiffness of the base plate further advantageously at the most 0.5% of the stiffness of the base plate. In the typical case where the base plate is made from steel and the contact plate is made from a polyester urethane rubber material e.g. Vulkollan® this yields a ratio of the stiffnesses of 200,000 $N/mm^2$ to 100 $N/mm^2$. The stiffness of the contact plate in this case is only 0.05% of the stiffness of the base plate.

The device according to the invention can be particularly advantageous when it includes at least one locking element through which the contact plate is lockable at the base plate. This locking element can be configured at the undercarriage of the device, in particular at the base plate or at the contact plate. Advantageously the locking element is configured at the contact plate. When this is the case it is furthermore advantageous when the locking element is configured integral in one piece with the contact plate.

The locking element can be for example a type of clip which is deflected by applying a force for example by stepping onto a transmission surface with a foot, wherein the locking element is deformed elastically. In this elastically deformed condition the locking element can be arranged at the base plate so that it establishes form locking with the base plate after the force is removed and the elastic deformation springs back wherein the locking element envelops the base plate in a forming locking manner. In order to apply the described force, it is particularly advantageous when the locking element extends in an edge portion of the contact plate, in particular when it extends from the edge portion in a direction that is oriented away from the device. This way it is possible in a particularly simple manner to load the locking element with a torque and deflected in this manner.

Arranging a locking element at the device, in particular at the contact plate is particularly advantageous in cases where a relative movement between the contact plate and the base plate is blocked in all directions of the device by direct form locking. Using the interlocking element, it is then possible to disengage a form locking of this type at least in a movement direction of the device and to move the device in this direction so that a relative movement between the contact plate and the remaining device is provided. Put differently the remaining device can be run off the contact plate in a particularly simple manner.

In proving upon the method described supra the object is achieved according to the invention by performing the following method step:

c) moving the base plate relative to the contact plate so that the base plate moves into at least one connection portion of the contact plate so that the base plate and the contact plate are directly connected with each other through form locking after the base plate is inserted into the connection portion.

Insertion according to the instant application is a translatoric relative movement between the contact plate and the base plate. In particular the insertion is performed so that the contact plate is placed onto a substrate and then the base plate or the remaining device in its entirety is moved onto the contact plate using normal driving operations of the device until the base plate is eventually inserted into the connection portion of the contact plate so that indirect form locking is provided. Advantageously the device can be moved from a rear end of the contact plate in a direction towards its front end, wherein the base plate moves into a connection portion of the contact plate during this movement.

The method according to the invention has many advantages. In particular it facilitates connecting the contact plate with the base plate without using tools. The advantages of this method have already been described supra. It is appreciated that the method according to the invention can be performed in a particularly simple manner by the device according to the invention that is described supra.

Independently from the method step c) described supra a method can be particularly advantageous which includes the following method steps:

d) after positioning the base plate on the contact plate elastically expanding the contact plate at least in one connection portion by a mounting force, e) moving at least a portion of the expanded connection portion over an edge of the base plate and subsequently removing the mounting force so that the contact plate springs back into its starting position where it was arranged without being loaded by the mounting force, wherein at least a portion of the connecting portion of the contact plate attaches to a top side of the base plate and engages the base plate directly through form locking.

The method step d) and e) recited supra can also be combined with the method step c) described supra For performing the method steps d) and e) it is required that the contact plate is made from a material which is elastically deformable by a force that can be applied by a human without any auxiliary devices. Thus, in particular a synthetic material is suitable in particular a polyester urethane rubber material.

Also, the second method recited herein has the advantages recited supra in conjunction with the first method. In particular the method can be performed without tools or other auxiliary devices at a construction site. The force transmitting connection between the base plate and the contact plate is thus always achieved by direct form locking between both components.

BRIEF DESCRIPTION OF THE DRAWINGS

The device and the method according to the invention are subsequently described in more detail based on an embodiment with reference to drawing figures, wherein.

DETAILED DESCRIPTION OF THE INVENTION

Figure 1:
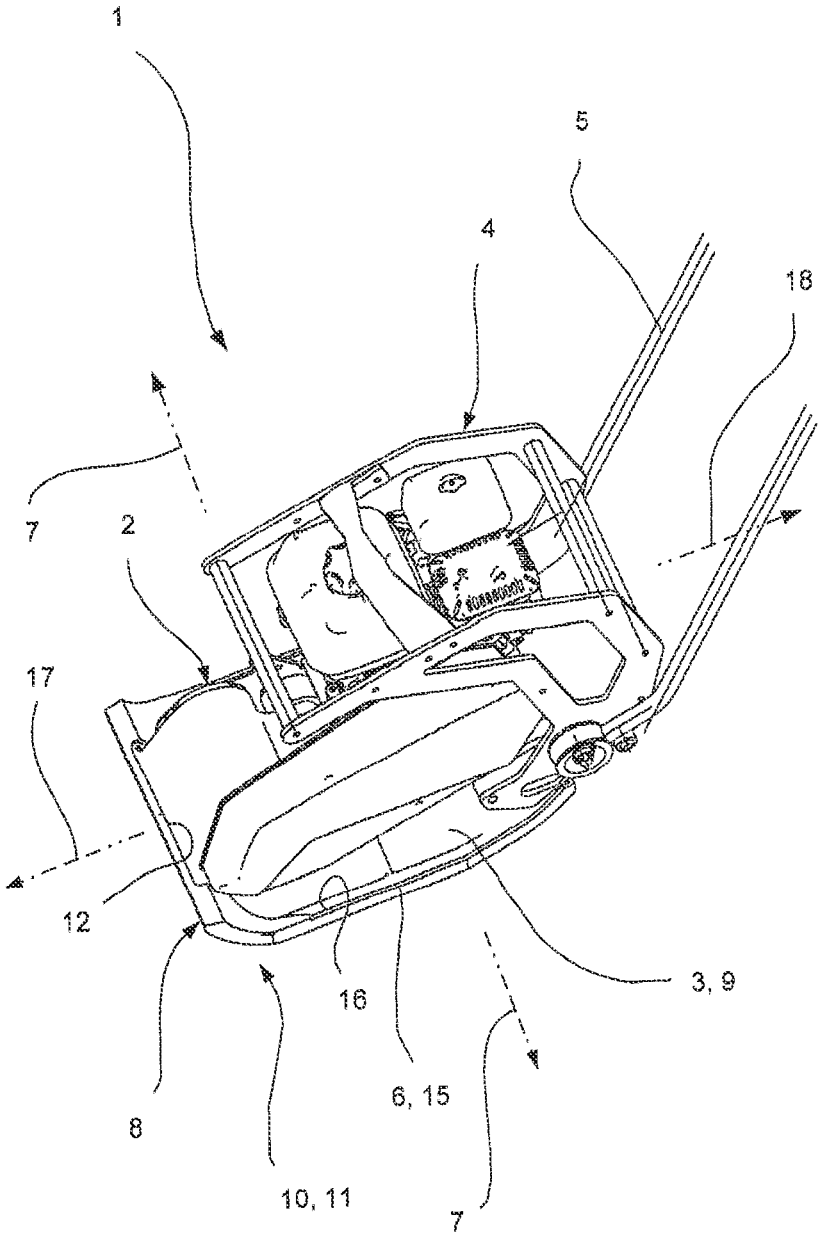
FIG. 1 illustrates a device according to the invention in a perspective view.
Figure 2:
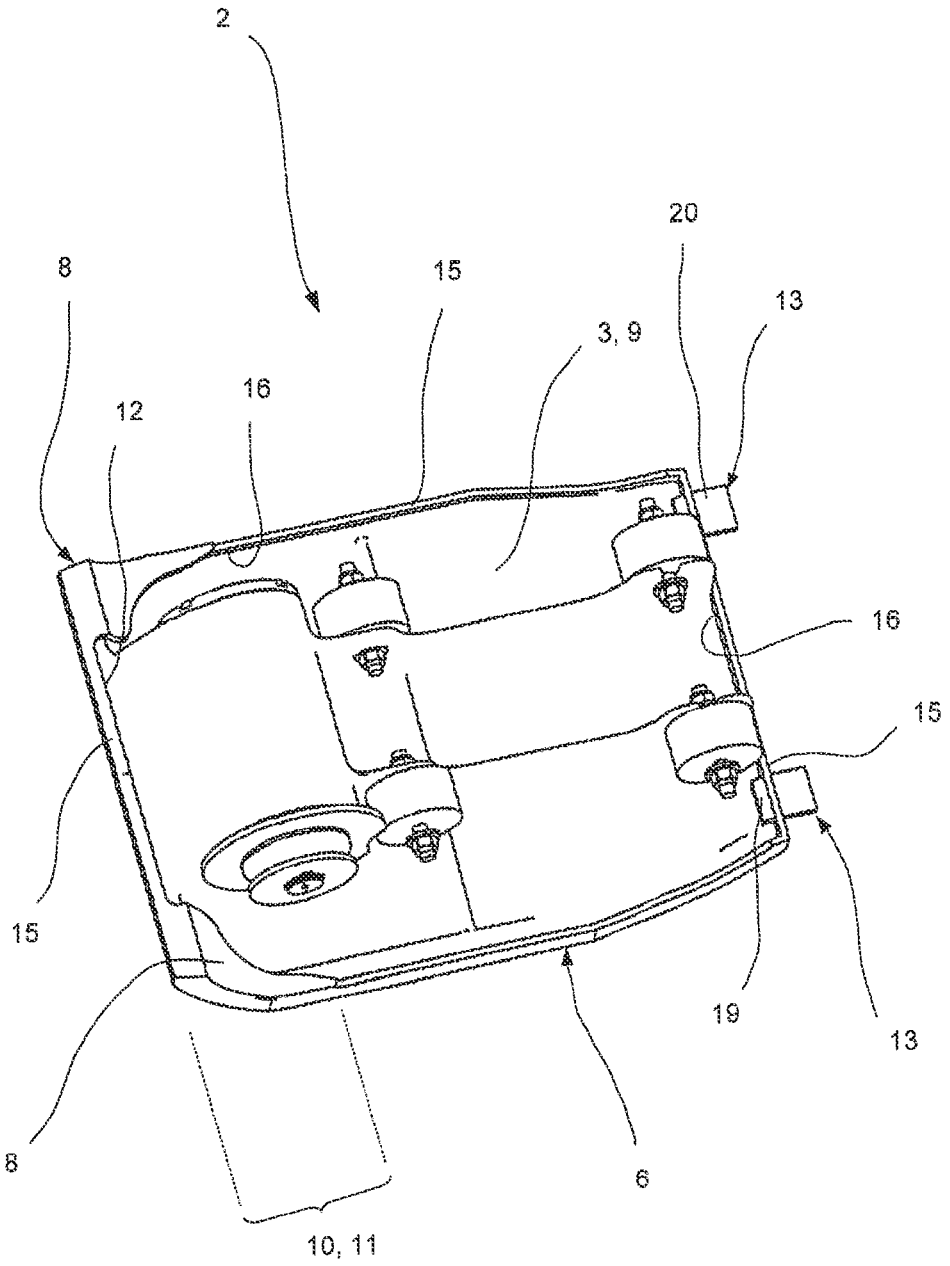
FIG. 2 illustrates a perspective view of an undercarriage of the device according to the invention wherein the undercarriage includes a base plate with a contact plate arranged thereon.
Figure 3:
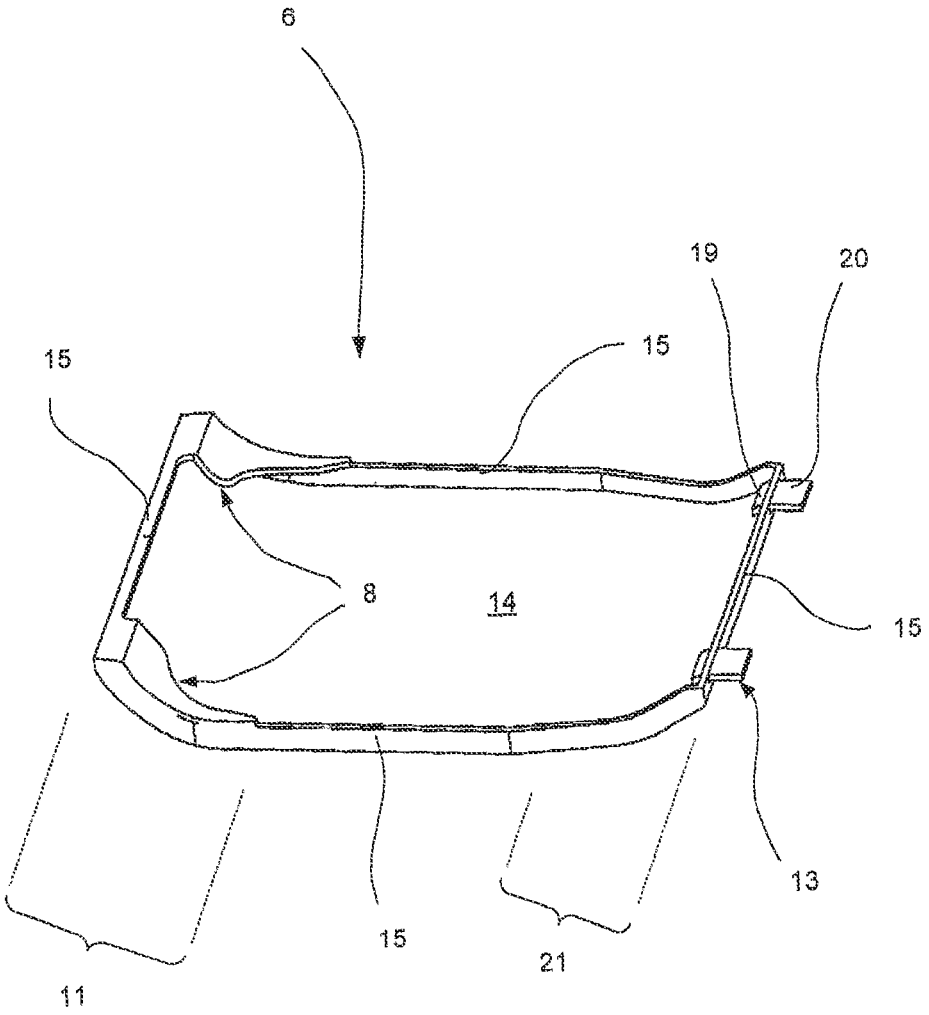
FIG. 3 illustrates a perspective view of a contact plate according to the invention.

The embodiment that is illustrates in FIGS. 1-3 includes a device 1 for compacting a substrate. The device 1 is formed by a hand operated vibrating plate. The device 1 includes a superstructure 4 and an under carriage 2, wherein the superstructure 4 and the under carriage 2 are connected with each other in a force transmitting manner. A vibration exciter is arranged at the super structure 4 and configured to force the super structure 4 and the undercarriage 2 to vibrate due to the force transmitting connection. A substrate that respectively has to be compacted is compactable by the vibration that is excited by the vibration exciter. The super structure 4 cooperates with a tow bar 5 which is arranged at the superstructure 4 with buffer elements arranged there between. The device 1 is controllable overall by the tow bar 5 by a person operating the device 1. In particular a movement direction of the device 1 can be influenced by the tow bar 5.

A base plate 3 is arranged at the undercarriage 2 and configured to come into direct contact with the respective substrate to be compacted. The base plate 3 is typically formed by a particularly wear-resistant material, in particular steel, is appreciated that the base plate 3 is exposed to significant operating forces during operation of the device 1 according to the invention which leads to a strong wear of the base plate 3. Due to its particularly high stiffness, the substrate to be compacted is subjected to significant forces, In typical applications where the device 1 is used for compacting lose ground, e.g., sandy ground, an impact of the force on the ground, in particular a friction force imparted by the baseplate, is irrelevant. However, in situations where a substrate is processed whose surface properties are to comply with optical requirements directly using the base plate 3 on the substrate can lead to undesirable damages to the surface. In order to prevent damages, the substrate 3 is provided with a contact plate 6 in the illustrated embodiment which acts as a damper plate. The contact plate 6 is formed from a polyester urethane rubber. Due to reduced stiffness of the material of the contact plate 6 compared to the material of the base plate 3, the contact plate is configured to evenly distribute forces that are applied from the base plate 3 to the substrate to be compacted and thus to avoid a punctiform loading of the substrate and in particular of its surface.

The base plate 3 and the contact plate 6 are connected with each other in a force transmitting manner. Thus, the contact plate 6 includes two forward connection portions 8 that are arranged in a forward end section 11 of the contact plate 6. The connections portions 8 are configured to engage corresponding form locking portions 10 of the base plate 3 through form locking. In the illustrated embodiment this is facilitated in that the connection portions 8 reach around the base plate 3 in forward corner portions of the base plate 3. Thus, the material of the contact plate 6 is run in the connection portions 8 over a front edge 12 of the base plate 3 to a top side 9 of the baseplate 3. There the material extends above the topside 9 of the base plate 3 and thus envelopes the base plate 3 in its form locking portions 10 through form locking. Put differently, the contact plate 6 is provided as a negative of the base plate 3 in connection portions of the contact plate 6, so that the base plate 3 engages the connection portions 8 of the contact plate 6 with form locking portions 10 of the base plate 3 precisely fitting.

This creates a form locking connection between the contact plate 6 and the base plate 3 which provides form locking according to the instant application. This form locking between the connection portion 8 of the contact plate 6 and the form locking portions 10 of the base plate 3 provides that the base plate 3 is not movable in a forward direction 17 of the device 1 relative to the contact plate 6. Put differently, the contact plate 6 is dragged along due to the forward movement of the base plate 3 during the forward movement of the device 1.

It is appreciated that no tools are required to form the form locking connection between the contact plate 6 and the base plate 3 described supra. Advantageously the contact plate 6 is placed on a substrate form mounting and then the remaining device 1 is run onto the contact plate 6 through a forward movement until the base plate 3 completely engages connection portions 8 of the contact plate 6 with forward form locking portions 10. As soon as this is the case, mounting the contact plate 6 at the base plate 3 is substantially completed.

As evident in particular in FIGS. 2 and 3 of the instant application the contact plate 6 is provided with a circumferential collar 15 adjacent to the connection portions 8 wherein the circumferential collar 15 extends perpendicular to a base plate 14 of the contact plate 6. The collar 15 is configured along an outer portion of the contact plate 6 so that it is configured to engage with a corresponding outer edge 16 of the base plate 3 through form locking. This cooperation of the contact plate 6 with the base plate 3 is evident in particular from the illustration according to FIG. 2.

The circumferential collar 15 of the contact plate 6 provides that in addition to blocking a relative movement between the base plate 3 and the contact plate 6 in the forward direction 17 of the device 1 relative movements in the backward direction 18 and in the sideward direction are blocked. This way it is possible to move the device 1 according to the invention in any direction without causing an unintentional disengagement of the contact plate 6 from the base plate 3.

In a rear end portion of the contact plate 6 the contact plate 6 includes a total of two locking elements 13. The locking elements 13 are configured to provide reversible form locking between the contact plate 6 and the base plate 3. For this purpose the locking elements 13 are respectively provided with a form locking section 19 extending towards a center of the contact plate 6 wherein the form locking section is configured to engage a top side 9 of the base plate 3 in a form locking manner. Differently from the forward connection portions 8 of the contact plate 6 the form locking sections 19 are provided significantly smaller so that it is possible to move a respective form locking section 19 by displacing the respective entire locking element 13 so that it does not engage the base plate 3 through a form locking engagement anymore. Thus, the interlocking elements 13 include a transmission section 20 that extends away from the contact plate 6 and which can be displaced in a particularly simple manner by stepping on it with a foot.

During dismounting of the contact plate 6 the directly form locking connection between the contact plate 6 and the base plate 3 can be disengaged in a particularly simple manner wherein the remaining device 1 can be moved in the backward direction 18 relative to the contact plate 6 after disengageing the locking elements from the base plate 3 until the contact plate 6 and the remaining device 1 are provided separate from each other again. Thus, it is appreciated that the material of the contact plate 6 is elastic enough so that it can deform under the mass of the remaining device 1 so that the device 1 can move over the contact plate 6 in spite of an upward curved configuration of the contact plate 6 in its rear end portion 21 without damaging the contact plate 6.

Alternatively or in addition to the form locking portions 8 illustrated herein, it is conceivable that the contact plate 6 has one or plural connection portions at least in sections along its outer edge, advantageously circumferentially wherein the connection portions are configured so that they can be expanded by elastic deformation and can be placed in this manner over the base plate 3 in a manner that is similar to the locking elements 13 described supra. As a result, it is only relevant for achieving the success according to the invention that the contact plate 6 and the base plate 3 are connected with each other in a force transferring manner by providing direct form locking so that a movement of the base plate 3 relative to the contact plate 6 is locked in the forward direction 17, advantageously also in the backward direction 18, further advantageously in all movement directions of the device 1.

The features described supra for the illustrated embodiment are usable independently from each other as a matter of principle as deemed appropriate by a person skilled in the art. The individual features of the device 1 according to the invention, therefore, do no depend upon each other.

REFERENCE NUMERALS AND DESIGNATIONS

1 Device
2 Undercarriage
3 Base plate
4 Super structure
5 Tow bar
6 Contact plate
7 Sideways direction
8 Connection portion
9 Topside of base plate
10 Form locking portion
11 Forward end section
12 Forward edge
13 Locking element
14 Base surface
15 Outer collar
16 Outer edge
17 Forward direction
18 Backward direction
19 Form locking section
20 Transmission section
21 Rear end section

What is claimed is:

1. A device for compacting a substrate, the device comprising:

an under carriage with a base arranged at the under carriage;

a superstructure which is connected to the under carriage so that a force is transferable between the superstructure and the under carriage and a vibrator by which the base plate of the under carriage is excitable to vibrate; and a contact plate which is arranged at bottom side of the base plate which bottom side is oriented away from the superstructure so that the contact plate directly contacts the substrate to be compacted during an operation of the device, wherein the contact plate and the base plate are connected with each other so that the contact plate and the base plate are disengageable from each other without damaging the contact plate or the base plate, wherein the contact plate includes at least one connection portion that is configured to engage the base plate through direct form locking so that a force transmitting connection between the contact plate and the base plate is establishable exclusively by the connection portion, and wherein the at least one connection portion is formed at the contact plate so that the at least one connection portion extends in an installed position of the contact plate from a bottom side of the base plate to a top side of the base plate that is oriented towards the super structure and engages the super structure with the topside at this location.

2. The device according to claim 1, wherein the force transmitting connection between the contact plate and the base plate is free from additional connection devices.

3. The device according to claim 1, wherein the contact plate and the base plate are connectable with each other and disengagable from each other without tools.

4. The device according to one of the claim 1, wherein the contact plate (6) is integrally provided in one piece.

5. The device according to one of the claim 1, wherein the contact plate includes at least one outer collar that s oriented perpendicular to a base surface of the contact plate, wherein the outer collar forms a stop surface for a corresponding outer edge of the base plate in an installed condition of the contact plate so that a movement of the base plate relative to the contact plate in a direction towards the collar of the contact plate is blocked.

6. The device according to claim 1, wherein the contact plate is formed from a synthetic material, whose stiffness is significantly less than a stiffness of the base plate, wherein a stiffness of the contact plate is at the most 0.1% of the stiffness of the base plate.

7. The device according to claim 1, wherein the contact plate includes a plurality of connection portions, wherein the connection portions engage the base plate overall so that a movement of the contact plate relative to the base plate is blocked in a forward direction of the device as well as in a reverse direction of the device.

8. The device according to claim 1, wherein the at least one connection portion is arranged at a forward end section of the contact plate, and wherein the at least one connection portion cooperates with the base plate so that the at least one connection portion covers a front edge of the base plate at least partially.

9. The device according to claim 1, wherein at least one locking element is arranged at the contact plate, and wherein the contact plate is lockable at the base plate by the locking element.

10. The device according to claim 1, wherein at least a rear edge side of the contact plate is configured flat so that the device is configured to run with its base plate at the rear edge side onto the contact plate, wherein a thickness of the contact plate at least at the rear edge side is not not more than 4 cm.

11. A method for mounting a contact plate at a base plate of a device for compacting a substrate, the method comprising the steps:

positioning the base plate and the contact plate relative to each other so that the base plate contacts the contact plate at least substantially completely;

connecting the base plate and the contact plate with each other in a force transferring manner, so that a movement of the contact plate relative to the base plate is blocked at least in a forward direction of the device; and moving the base plate relative to the contact plate so that the base plate moves into at least one connection portion of the contact plate so that the base plate and the contact plate are connected with each other by direct form locking after inserting the base plate into the connection portion.

12. The method according according to claim 11, further comprising steps:

after positioning the base plate on the contact plate elastically expanding the contact plate at least in a connection portion by a mounting force; and moving at least a portion of the expanded connection portion over an edge of the base plate and subsequently reducing the mounting force so that the contact plate is applied at least with a portion of the connection portion to a top side of the base plate due to an elastic springback of the contact plate so that the contact plate engages the base plate by direct form locking.

* * * * *